US010843323B2

(12) United States Patent
Wang

(10) Patent No.: US 10,843,323 B2
(45) **Date of Patent: *Nov. 24, 2020**

(54) MANUAL TOOL CAPABLE OF UNFOLDING ONLY ONE WORK ACCESSORY

(71) Applicants: Hangzhou Great Star Industrial Co., Ltd., Hangzhou (CN); Hangzhou Great Star Tools Co., Ltd., Hangzhou (CN)

(72) Inventor: Weiyi Wang, Hangzhou (CN)

(73) Assignees: Hangzhou Great Star Industrieal Co., Ltd., Hangzhou (CN); Hangzhou Great Star Tools Co., Ltd., Hangzhou (CN)

( * ) Notice: Subject to any disclaimer, the term of this patent is extended or adjusted under 35 U.S.C. 154(b) by 215 days.

This patent is subject to a terminal disclaimer.

(21) Appl. No.: 15/907,607

(22) Filed: Feb. 28, 2018

(65) Prior Publication Data

US 2018/0290282 A1 Oct. 11, 2018

Related U.S. Application Data

(63) Continuation-in-part of application No. 14/369,840, filed as application No. PCT/CN2013/078818 on Jul. 4, 2013, now Pat. No. 9,908,248.

(30) Foreign Application Priority Data

Nov. 28, 2012 (CN) ..... 2012 1 0497065

(51) Int. Cl.
*B25F 1/04* (2006.01)
*B26B 11/00* (2006.01)
(Continued)

(52) U.S. Cl.
CPC ..... *B25F 1/04* (2013.01); *B26B 1/044* (2013.01); *B26B 5/00* (2013.01); *B26B 11/001* (2013.01)

(58) Field of Classification Search
CPC ..... B26B 11/001; B26B 1/044; B26B 5/00; B25F 1/04
(Continued)

(56) References Cited

U.S. PATENT DOCUMENTS 1,362,142 A * 12/1920 Rohrer ..... B26B 1/042 30/161
1,743,022 A * 1/1930 Carman ..... B26B 1/02 30/161
(Continued)

FOREIGN PATENT DOCUMENTS

CN 1047339 C 12/1999
CN 200995407 Y 12/2007
(Continued)

*Primary Examiner* — Hadi Shakeri
(74) *Attorney, Agent, or Firm* — The Webb Law Firm

(57) ABSTRACT

Disclosed is a manual tool capable of unfolding only one work accessory. The conventional manual tools may bring hidden risk to safety with more than two work accessories that may be unfolded simultaneously. According to the present invention, an associated accessory is arranged for a working state of a first work accessory and a second work accessory to transform from a folding state to an unfolding state; in the folding state where the first work accessory and the second work accessory are both folded, the associated accessory does not prevent any work accessory from unfolding; while in the unfolding state where one of the two work accessories is unfolded and the other one is folded, the associated accessory prevents the other one from unfolding, so as to ensure that only one work accessory can be unfolded during use, and if the unfolded work accessory is left unfolded, the other work accessory cannot be unfolded,
(Continued)

thereby eliminating the safety risk caused by unfolding multiple work accessories at the same time.

5 Claims, 13 Drawing Sheets

(51) Int. Cl.
*B26B 1/04* (2006.01)
*B26B 5/00* (2006.01)

(58) Field of Classification Search
USPC ..... 7/118
See application file for complete search history.

(56) References Cited

U.S. PATENT DOCUMENTS 2,263,415 A * 11/1941 Louis ..... B26B 1/042 30/160
2,806,282 A * 9/1957 Berg ..... B26B 11/00 30/143
4,606,123 A * 8/1986 Wrench ..... B26B 11/006 30/153
5,546,662 A 8/1996 Seber et al.
5,794,346 A * 8/1998 Seber ..... B26B 1/044 30/160
6,125,543 A * 10/2000 Jhones ..... B26B 1/042 30/155
RE42,906 E * 11/2011 Onion ..... B26B 1/044 30/160
8,966,691 B2 * 3/2015 Richards ..... B25F 1/04 7/118
2002/0029426 A1 * 3/2002 Seber ..... B25F 1/003 7/128
2003/0009886 A1 * 1/2003 Onion ..... B26B 1/044 30/161
2004/0078980 A1 * 4/2004 Cheng ..... B26B 1/044 30/161
2005/0278956 A1 * 12/2005 Ling ..... B25F 1/04 30/161

FOREIGN PATENT DOCUMENTS

CN 201092048 Y 7/2008
CN 201092051 Y 7/2008
CN 201092052 Y 7/2008
CN 201151124 Y 11/2008
CN 201385317 Y 1/2010
CN 201677334 U 12/2010
CN 201760883 U 3/2011
CN 102990615 A 3/2013
CN 202895168 U 4/2013
EP 0783938 A2 7/1997

* cited by examiner

I – I

II – II

MANUAL TOOL CAPABLE OF UNFOLDING ONLY ONE WORK ACCESSORY

CROSS-REFERENCE TO RELATED APPLICATION

This application is a Continuation-in-part of U.S. patent application Ser. No. 14/369,840 filed on Aug. 3, 2015, which is a National Stage Application of International Patent No. PCT/CN2013/078818 filed on Jul. 4, 2013, which claims priority to Chinese Patent Application No. 201210497065.2 filed Nov. 28, 2012, and the disclosure of each is hereby incorporated in its entirety by reference.

FIELD OF THE INVENTION

The present invention relates to manual tools, specifically to a manual tool capable of unfolding only one work accessory.

DESCRIPTION OF THE PRIOR ART

The conventional manual tools with two or more work accessories (such as cutting knife, tool bit with blade, screwdriver, bottle opener, file etc.) are equipped with two different accessories on two sides of the handle respectively. When the manual tool is in use, the work accessories folded in the handle can be unfolded simultaneously. For convenience, users tend to leave one work accessory (a screwdriver for instance) unfolded after using it and unfold another work accessory (a blade for instance). In this case, there would be at least two work accessories unfolded, which would bring hidden risk to safe handling.

A double-head knife as published in the Chinese Patent Application No. 200820083045, has two blades on two sides of the handle respectively, when it is used, anyone or both of the two blades can be unfolded. Such tool solved the problem from prior technology that the knives are single-functioned, however, it also brought some hidden risk. Suppose users unfold two heads simultaneously for convenience, they themselves or others can be hurt.

Thus there is a need for safe manual tools with plural work accessories in the market.

SUMMARY OF THE INVENTION

The technical problem to be solved and the task of the present invention is to overcome the defect that the conventional manual tools may bring hidden risk to safety with more than two work accessories that may be unfolded simultaneously, and to provide a manual tool capable of unfolding only one work accessory to ensure that only one work accessory can be unfolded in use. If the unfolded work accessory is left unfolded, the other work accessory cannot be unfolded.

To achieve the above-mentioned purpose, the manual tool capable of unfolding only one work accessory in the invention, comprises a handle, a first work accessory and a second work accessory; the first work accessory and the second work accessory are connected to the handle through a pivot and are capable of folding and unfolding; characterized in that an associated accessory is arranged for a working state of the first work accessory and the second work accessory to transform from a folding state to an unfolding state, the folding state being that both the first and second work accessory are folded, the unfolding state being that one of the first work accessory and the second work accessory is unfolded while the other one is folded; while in the folding state, the associated accessory does not prevent any work accessory from unfolding; in the unfolding state, the associated accessory prevents the other one from unfolding.

Specifically, it can be realized by way of the two following structures:

Firstly, the first work accessory and the second work accessory are connected to the two sides of the handle through the pivots respectively, wherein the associated accessory is a pull rod, a first member is fixed on the first work accessory and moves with the folding and unfolding of the first work accessory, a second member is fixed on the second work accessory and moves with the folding and unfolding of the second work accessory, the first member and the second member are coupled to the two ends of the pull rod, the first work accessory drives the first member to move after its unfolding, thus to drive the pull rod to move correspondingly to limit the motion of the second member, thus preventing the second work accessory from unfolding.

Specifically, the first work accessory is rotationally arranged to a first pivot at one end of the handle through a first axle sleeve fixed on the end of the first work accessory, an outer diameter of the first axle sleeve having a small diameter part and a large diameter part, the second work accessory is rotationally arranged to a second pivot at the other end of the handle through a second axle sleeve fixed on the end of the second work accessory, an outer diameter of the second axle sleeve having a small diameter part and a large diameter part.

The associated accessory is a pull rod which is set inside the handle and able to move along its length, the two ends of the pull rod surround the first axle sleeve and the second axle sleeve through a first through hole and a second through hole respectively, the first through hole has a first locking wall and the second through hole has a second locking wall.

While in the folding state, the small diameter part of the first axle sleeve faces the first locking wall and the small diameter part of the second axle sleeve faces the second locking wall, to allow the pull rod to move along its length without preventing any work accessory from unfolding.

While in the unfolding state, the small diameter part of the first axle sleeve faces the first locking wall, the large diameter part of the second axle sleeve faces the second locking wall, or the large diameter part of the first axle sleeve faces the first locking wall and the small diameter part of the second axle sleeve faces the second locking wall, to prevent the pull rod from moving along its length to prevent the first work accessory from unfolding.

More specifically, the large diameter part of the first axle sleeve and the large diameter part of the second axle sleeve are cylinder; the small diameter part of the first axle sleeve and the small diameter part of the second axle sleeve are longitudinal plane cut from a cylinder; the first locking wall and the second locking wall are plane. The pull rod is flake-like, and the first work accessory and the second work accessory are at the two sides of the pull rod respectively.

Secondly, the first work accessory and the second work accessory are arranged on the same pivot on the handle reversely.

A stroke slot is set on one work accessory, a pin is set on the other work accessory as the associated accessory, and the pin extends into the stroke slot.

While in the folding state, the pin is located at one side of the stroke slot and is able to move from the end to the other end of the stroke slot without preventing any work accessory from unfolding.

While in the unfolding state, the pin is located on the other end of the stroke slot to prevent the other work accessory from unfolding.

Further, a first unfolding blocking part and a first folding blocking part are equipped to the first work accessory inside the handle. When the first work accessory is unfolded, the first unfolding blocking part prevents the first work accessory from rotating toward unfolding direction and the first folding blocking part prevents the first work accessory from rotating toward folding direction.

A second unfolding blocking part and a second folding blocking part are equipped to the second work accessory inside the handle. When the second work accessory is unfolded, the second unfolding blocking part prevents the second work accessory from rotating toward unfolding direction and the second folding blocking part prevents the second work accessory from rotating toward folding direction.

More specifically, the first unfolding blocking part is a block along the unfolding direction of the first work accessory, the first folding blocking part is a rigid chip on a side of the first work accessory, and when the first work accessory is unfolded, an end of the rigid chip bends to the first work accessory out of its elasticity and holds against the first work accessory to prevent folding; the second unfolding blocking part is a block along the unfolding direction of the second work accessory, the second folding blocking part is a rigid chip on a side of the second work accessory, and when the second work accessory is unfolded, an end of the rigid chip bends to the second work accessory out of its elasticity and holds against the second work accessory to prevent folding.

Inside the handle, a plate is arranged between the first work accessory and the second work accessory. The first unfolding blocking part, the first folding blocking part, the second unfolding blocking part and second folding blocking part are set on the plate.

Outlines of the both ends of the plate are same as the outline of the handle. The plate is equipped to the end of the handle through the pivot. A through hole is arranged on the plate to allow the pin to pass though.

The beneficial effect of the invention is that by equipping an associated accessory which can switch between a folding state and an unfolding state to the first work accessory and the second work accessory, the associated accessory does not prevent any of the work accessory from unfolding in the folding state, while it would prevent the other work accessory from unfolding in the unfolding state, thereby ensuring that only one work accessory can be unfolded. If the unfolded work accessory is not unfolded, the other work accessory cannot be unfolded, thereby eliminating safety risk from unfolding plural work accessories.

Figure 1:
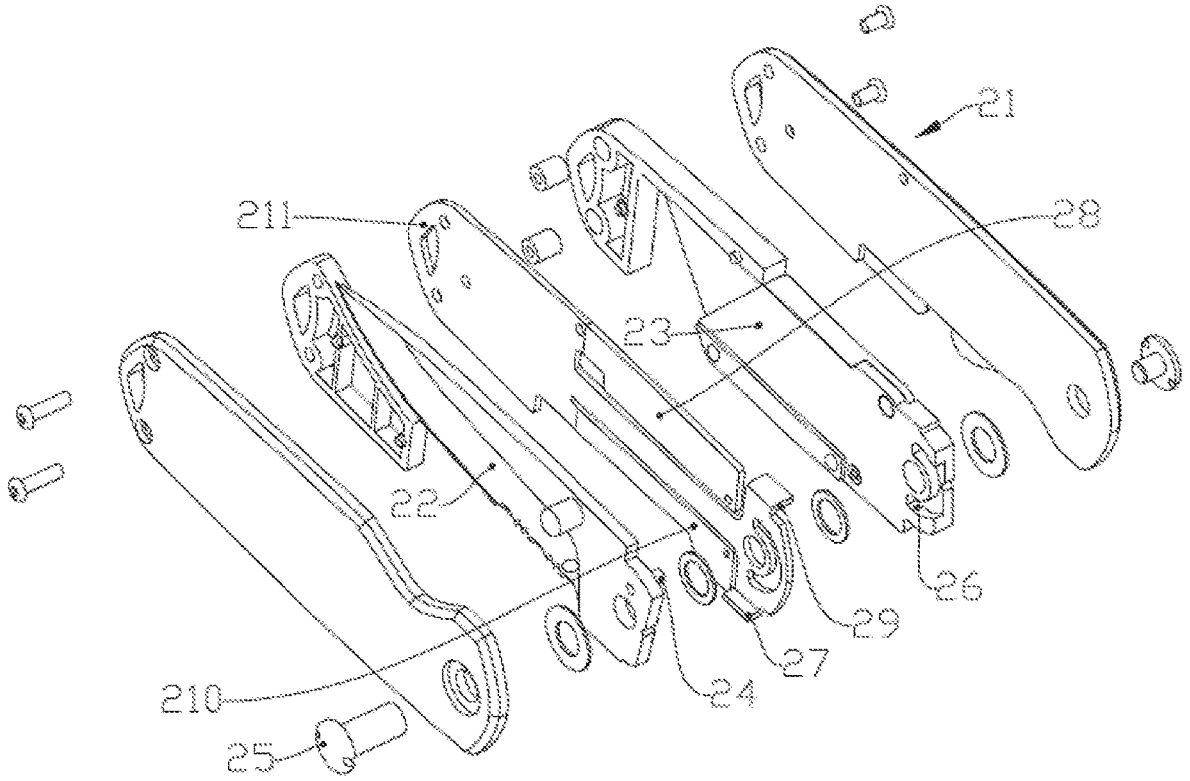
FIG. 1 is a schematic drawing of assembly relationship of the assembly units of one structure of the present invention.
Figure 2:
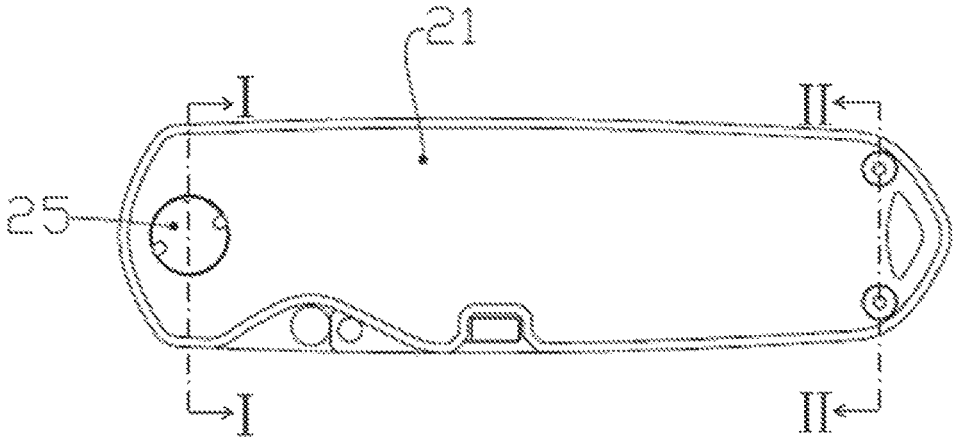
FIG. 2 is a schematic drawing of the structure shown in FIG. 1 which is assembled and in the folding state.
Figure 3:
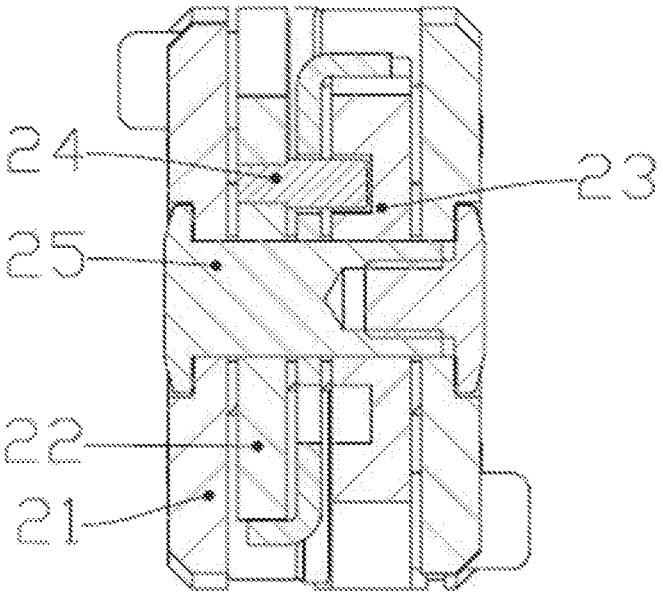
FIG. 3 is an enlarged section view taken along line I-I in FIG. 2.
Figure 4:
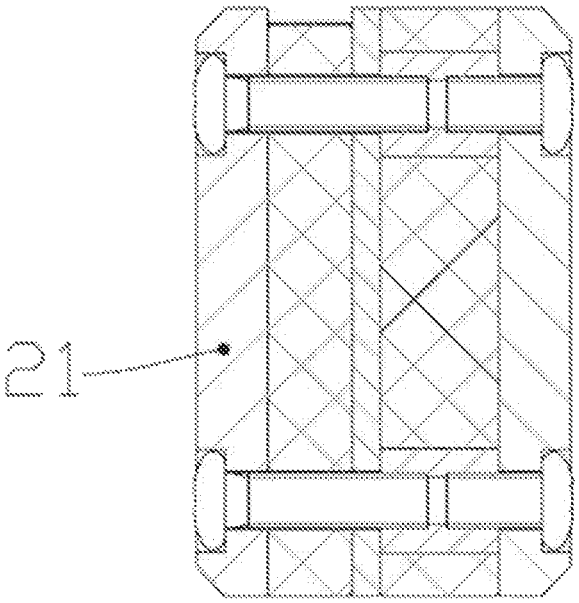
FIG. 4 is an enlarged section view taken along line II-II in FIG. 2.
Figure 5:
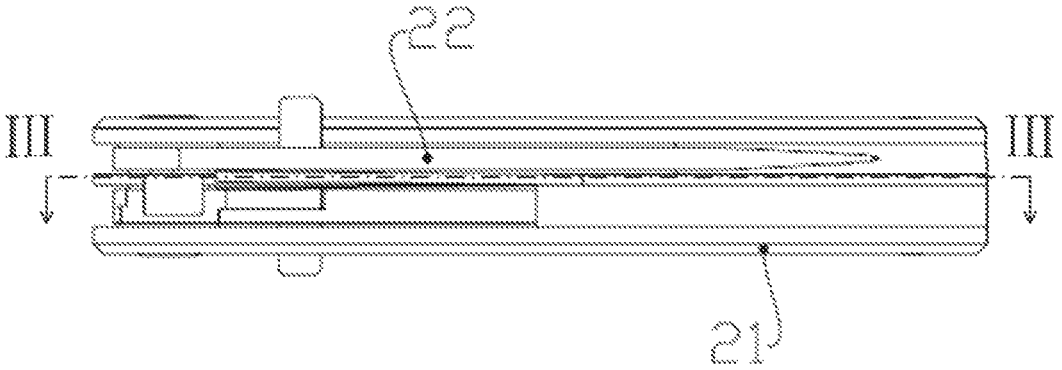
FIG. 5 is a top view of FIG. 2.
Figure 6:
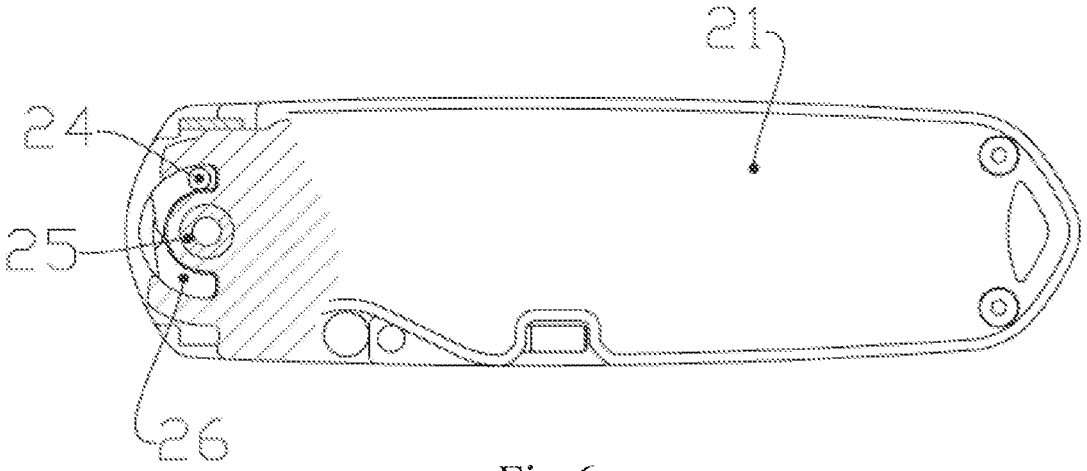
FIG. 6 is a section view taken along line III-III in FIG. 5.

11—handle, 12—first work accessory, 13—second work accessory, 14—associated accessory, 15—first axle sleeve, 16—small diameter part of the first axle sleeve, 17—large diameter part of the first axle sleeve, 18—first pivot, 19—second axle sleeve, 110—small diameter part of the second axle sleeve, 111—large diameter part of the second axle sleeve, 112—second pivot, 113—first through hole, 114—second through hole, 115—first locking wall, 116—second locking wall

21—handle, 22—first work accessory, 23—second work accessory, 24—associated accessory, 25—pivot, 26—stroke slot, 27—first unfolding blocking part, 28—first folding blocking part, 29—second folding blocking part, 210—second folding blocking part, 211—plate

31—handle, 32—first work accessory, 33—second work accessory, 321—through hole, 331—through hole, 34—associated accessory, 341—first through hole, 342—second through hole, 343—first locking wall, 344—second locking wall, 35—first pivot, 36—second pivot, 37—first member, 371—first end, 372—second end, 373—first arc surface, 38—second member, 381—third end, 382—fourth end, 383—second arc surface.

DETAILED DESCRIPTION OF THE PREFERRED EMBODIMENTS

Hereinafter, the invention would be further explained with reference to the drawings and embodiments.

The manual tool capable of unfolding only one work accessory of the invention includes a handle 11/21/31, a first work accessory 12/22/32 and a second work accessory 13/23/33 connected through pivot(s) to the handle, both of which can be unfolded and folded. The concept of the invention is to arrange a associated accessory 14/24/34, which can switch between a folding state and an unfolding state, to the first work accessory 12/22/32 and the second work accessory 13/23/33. The folding state is that the first work accessory and the second work accessory are both folded, and the unfolding state is that one of the first work accessory and the second work accessory is unfolded while the other is folded. The associated accessory would not prevent any work accessory from unfolding in the folding state while the associated accessory would prevent the other work accessory from unfolding in the unfolding state.

Embodiment 1 (Referring to FIGS. 11-19)

The first work accessory 12 is rotationally surrounding the first pivot 18 that is arranged on one end of the handle 11 by the first axle sleeve 15 set on the end of the first work accessory 12. The outer diameter of the first axle sleeve 15 has a small diameter part 16 and a large diameter part 17. The second work accessory 13 is rotationally surrounding the second pivot 112 arranged on the other end of the handle 11 by the second axle sleeve 19 arranged on the end of the second work accessory 13. The outer diameter of the second axle sleeve 19 has a small diameter part 110 and a large diameter part 111.

Figure 13:
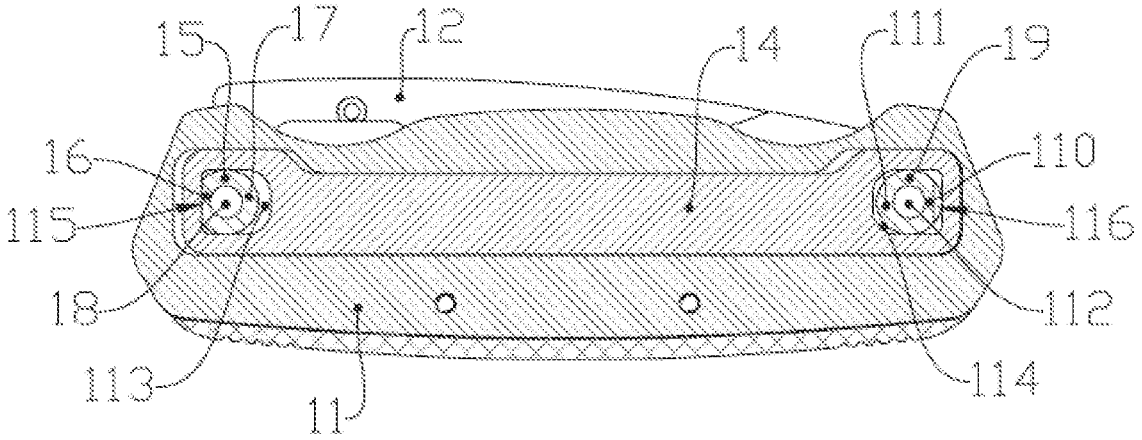
FIG. 13 is a section view taken along line VII-VII in FIG. 12.
Figure 16:
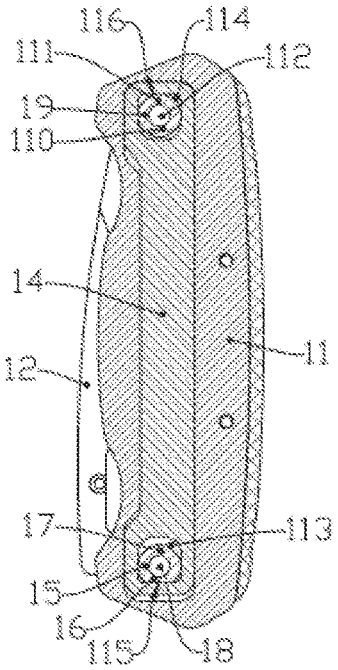
FIG. 16 is a section view taken along line IX-IX in FIG. 15.
Figure 19:
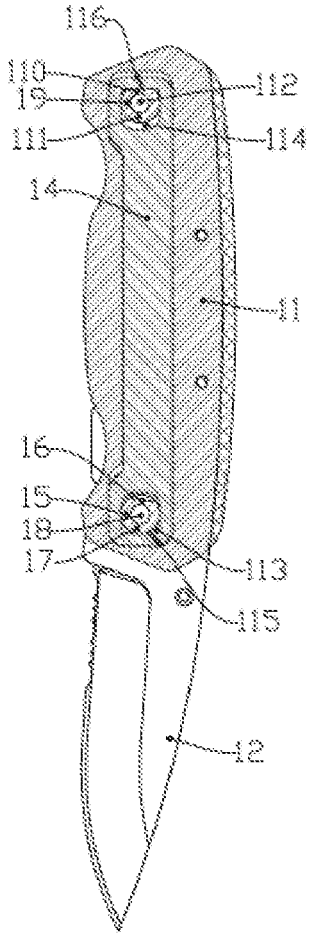
FIG. 19 is a section view taken along line XI-XI in FIG. 18.

Referring to FIGS. 13, 16 and 19, the associated accessory 14 is a pull rod assembled inside the handle 11 and can move along its length. The two ends of the pull rod are surrounding the first axle sleeve 15 and the second axle sleeve 19 through the first through hole 113 and the second through hole 114 respectively. The first through hole 113 has the first locking wall 115 and the second through hole 114 has the second locking wall 116. The first through hole 113 and the second through hole 114 can be connected, that is to say that the first locking wall 115 has the first axle sleeve 15 on the outside and the second locking wall 116 has the second axle sleeve 19 on the outside.

Figure 11:
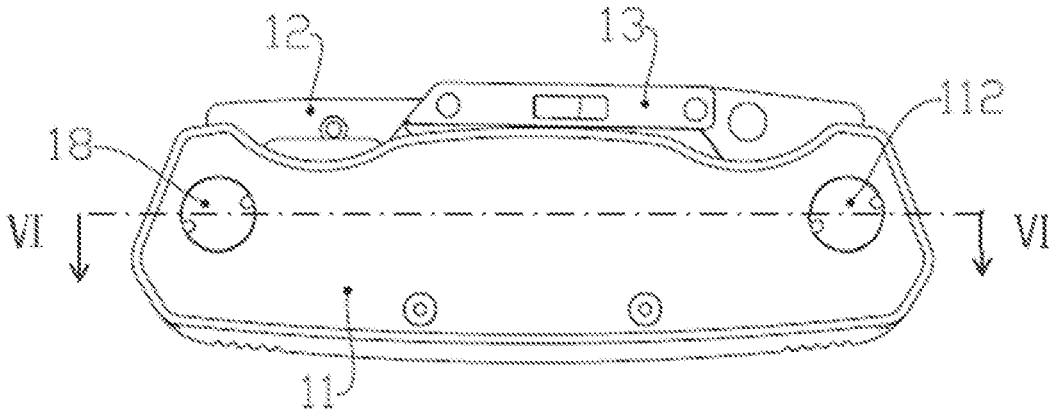
FIG. 11 is a schematic drawing of another structure of the invention which is in the folding state.
Figure 12:
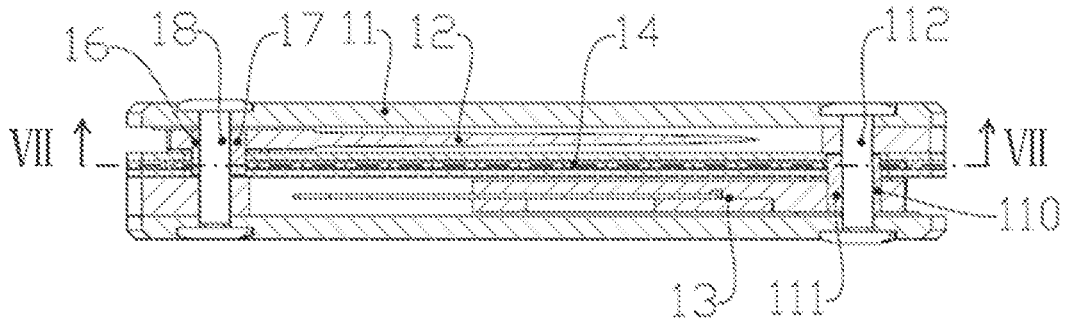
FIG. 12 is a section view taken along line VI-VI in FIG. 11.

Referring to FIGS. 11-13, in the folding state, the small diameter part 16 of the first axle sleeve 15 faces to the first locking wall 115 and the small diameter part 110 of the second axle sleeve 19 faces to the second locking wall 116, these make the pull rod move along its length without preventing any of the work accessory from unfolding (as shown in FIG. 13, when unfolding the first work accessory 12 on the left, the small diameter part 16 of the first axle sleeve 15 would act upon the first locking wall 115 to push the pull rod rightwards, enabling the first axle sleeve 15 to rotate from the small diameter part 16 to the large diameter part 17, thereby unfolding the first work accessory 12; when unfolding the second work accessory 13 on the right, the small diameter part 110 of second axle sleeve 19 is kept away from the first locking wall 116, enabling the second axle sleeve 19 to rotate from the small diameter part 110 to the large diameter part 111, thereby unfolding the second work accessory 13.

Figure 14:
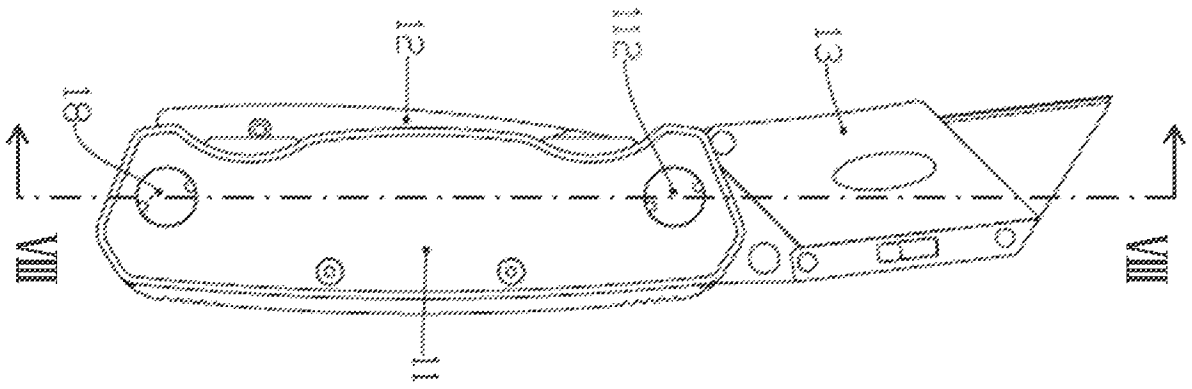
FIG. 14 is a schematic drawing of the unfolded second work accessory of the structure shown in FIG. 11.
Figure 15:
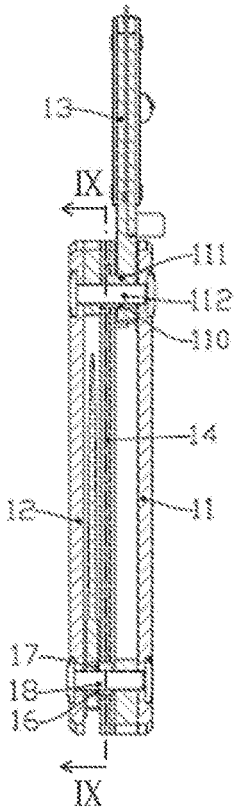
FIG. 15 is a section view taken along line VIII-VIII in FIG. 14.
Figure 17:
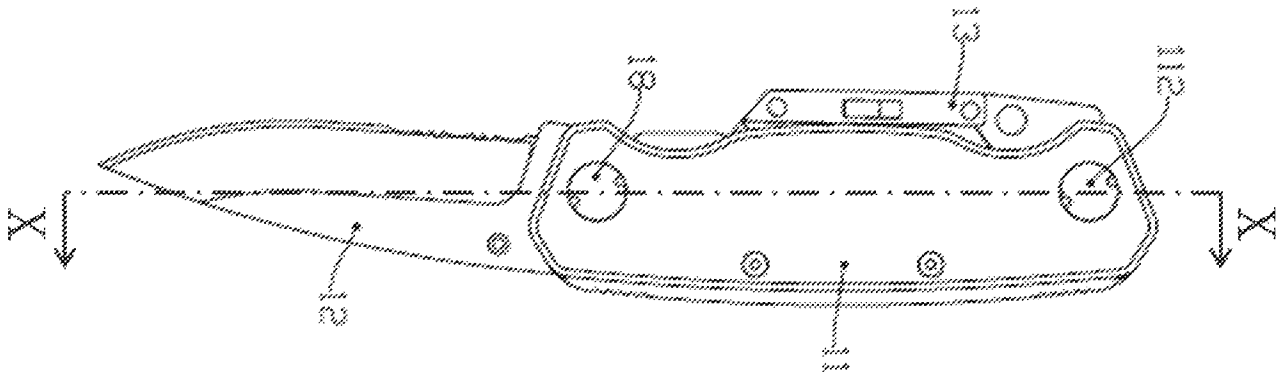
FIG. 17 is a schematic drawing of the unfolded first work accessory of the structure shown in FIG. 11.
Figure 18:
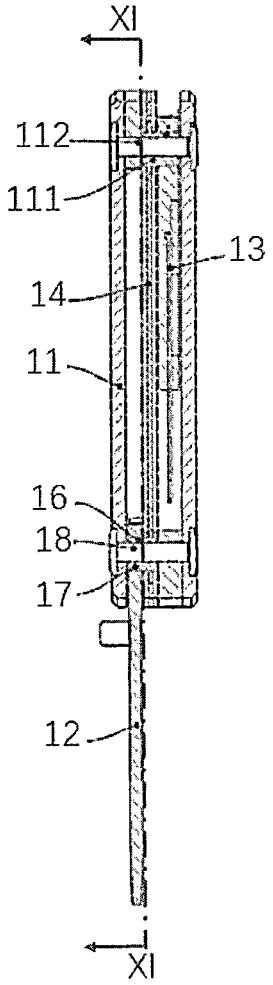
FIG. 18 is a section view taken along line X-X in FIG. 17.

In the unfolding state, the second work accessory 13 unfolds to drive the first axle sleeve 15 to rotate. The small diameter part 16 of the first axle sleeve 15 faces to the first locking wall 115 and the large diameter part 111 of the second axle sleeve 19 turns to face to the second locking wall 116 (as shown in FIGS. 14-16), preventing the pull rod from moving along its length to prevent the first work accessory from unfolding (in this case, the second work accessory 13 is unfolded while the first work accessory 12 is folded, given that the pull rod can not move along its length, when the second work accessory 13 rotates towards the folding direction, the second axle sleeve 19 would rotate from the large diameter part 111 to the small diameter part 110 without being confined by the second locking wall 116, thus can be unfolded; when the first work accessory 12 rotates towards the unfolding direction, the small diameter part 16 of the first axle sleeve 15 would rotate to the large diameter part 17, confined by the first locking wall 115, the first work accessory 12 cannot be unfolded). Or the first work accessory 12 drives the first axle sleeve 15 to rotate. The large diameter part 17 of first work accessory 12 turns to face the first locking wall 115, the small diameter part 110 of second axle sleeve 19 faces to the second locking wall 116 (as shown in FIGS. 17-19), preventing the pull rod from moving along its length to prevent the second work accessory from unfolding (in this case, the first work accessory 12 is unfolded while the second work accessory 13 folded, since the pull rod cannot move along its length, when the first work accessory 12 rotates towards the folding direction, the first axle sleeve 15 rotates from the large diameter part 17 to the small diameter part 16 without being confined by the first locking wall 115, thus the first work accessory 12 can be folded; when the second work accessory 13 rotates towards the unfolding direction, the small diameter part 110 of the second axle sleeve 19 rotates to the large diameter part 111, confined by the second locking wall 116, the second work accessory 13 cannot be unfolded).

To achieve the above-mentioned purpose, in the invention, the space between the first locking wall 115 and the second locking wall 116 is bigger than or equal to the utmost outer length between the first axle sleeve 15 and the second axle sleeve 19 when the large diameter part 17 of the first axle sleeve 15 faces to the first locking wall 115 and the small diameter part 110 of the second axle sleeve 19 faces to the second locking wall 116. The space should also be bigger than or equal to the utmost outer length between the first axle sleeve 15 and the second axle sleeve 19 when the large diameter part 111 of the first axle sleeve 15 faces to the first locking wall 116 and the small diameter part 16 of the second axle sleeve 15 faces to the second locking wall 115. Also, the space should be smaller than the utmost outer length between the first axle sleeve 15 and the second axle sleeve 19 when the large diameter part 17 of the first axle sleeve 15 faces to the first locking wall 115 and the large diameter part 111 of the second axle sleeve 19 faces to the second locking wall 116.

Specifically, in order to obtain a better blocking effect, the large diameter part 16 of the first axel sleeve and the large diameter part 111 of the second axel sleeve are cylindrical, while the small diameter part 16 of the first axel sleeve and the small diameter part 110 of the second axel sleeve are longitudinal planes cut out of a cylinder. The first locking wall 115 and the second locking wall 116 are planar.

In order to obtain a compact structure, the pull rod is plate-like, the first work accessory 12 and the second work accessory 13 are located on the two sides of the pull rod respectively. Each of the first work accessory 12 and the second work accessory 13 has a hole corresponding to and surrounding the first axle sleeve 15 and the second axel sleeve 19 respectively, enabling the first work accessory 12 and the second work accessory 13 to drive the first axel sleeve 15 and the second axel sleeve 19 to rotate when being unfolded or folded.

Referring to the Figures, the first work accessory or the second work accessory is a blade mounting frame with a replaceable blade while the other one is a general knife.

The embodiment is not limited to the cases that only one accessory is set on one end, but can be extend to the cases that a plurality of accessories are set on one end and the accessories on one end can not be unfolded if one of the accessories on the other end is unfolded. For instance, one end of the handle is equipped with a first accessory and a third accessory while the other end with a second accessory and a fourth accessory. The second accessory and the fourth accessory cannot be unfolded if the first or the third accessory is unfolded. The instance herein and other similar embodiment are all in the protection range of the Claims.

Embodiment 2 (Referring to FIGS. 1-10)

A first work accessory 22 and a second work accessory 23 are reversely arranged on the same pivot 25 of the handle 21 (being reversely set means that the unfold direction of the first work accessory and the second work accessory are opposite, as shown in FIG. 1. The first work accessory is unfolded when rotating clockwise while the second work accessory is unfolded when rotating anticlockwise).

A stroke slot 26 is set on one work accessory (a stroke slot 26 is set on the second work accessory 23 is shown in the Figure) and a pin is set on the other work accessory (a pin set on the first work accessory 22 is shown in the Figure) as the associated accessory 24, and the pin extends into the stroke slot 26 (the position of the stroke slot 26 and the pin can be exchanged in a specific embodiment).

In the folding state (as shown in FIGS. 1-6), the pin is located on one end of the stroke slot 26. Relative to the stroke slot 26, the pin can move from one end to the other without preventing any work accessory from unfolding (as shown in FIG. 1, the pin is on the top of the stroke slot 26, thus the first work accessory 22 can rotate clockwise and the stroke slot 26 maintains its position, while the pin can rotate to the bottom of the stroke slot 26, thus unfolding the first work accessory 22. Also the second work accessory 23 can rotate anticlockwise and the rotate maintains its position. After the stroke slot 26 rotates to a certain angle, the pin would alternate its position relative to the stroke slot from one end to the other, thus unfolding the second work accessory 23).

Figure 7:
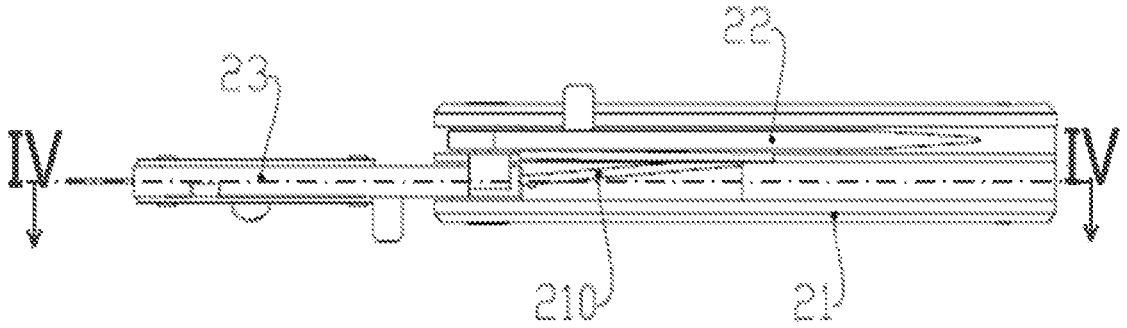
FIG. 7 is a schematic drawing of the unfolded second work accessory taken along the view direction of FIG. 5.
Figure 8:
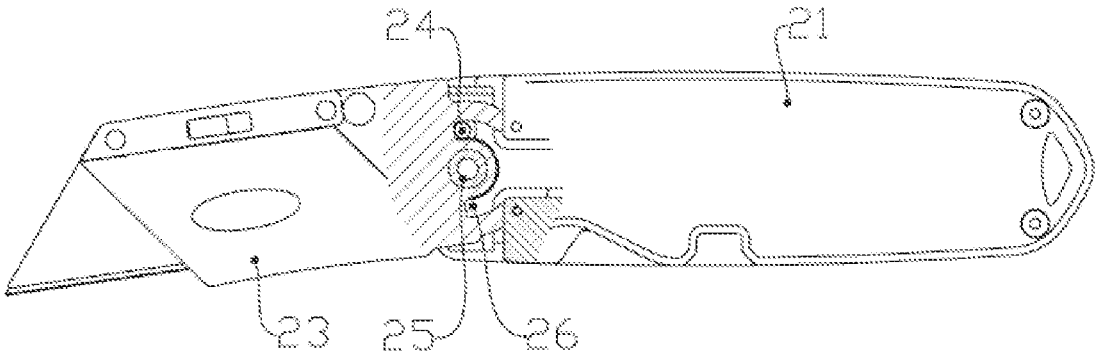
FIG. 8 is a partial section view taken along line IV-IV in FIG. 7.
Figure 9:
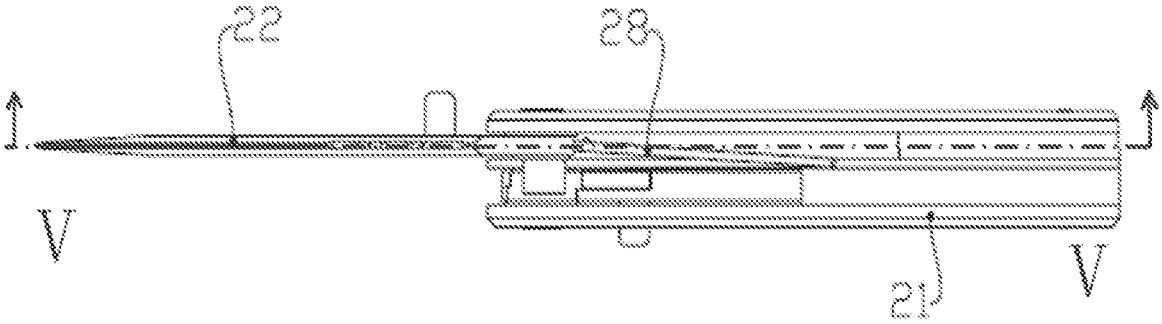
FIG. 9 is a schematic drawing of the unfolded first work accessory taken along the view direction of FIG. 5.
Figure 10:
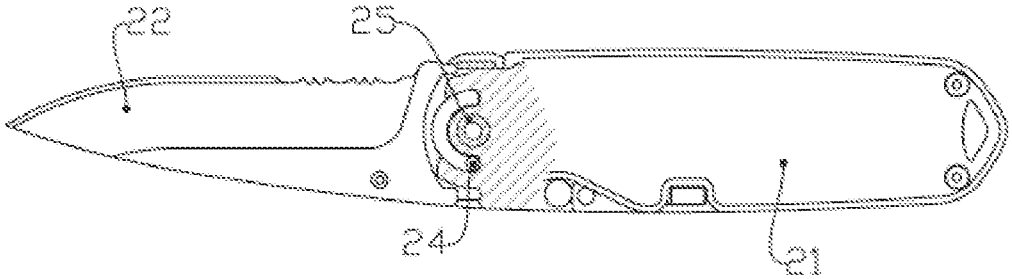
FIG. 10 is a partial section view taken along line V-V in FIG. 9.

In the unfolding state, the pin is located on the other end of the stroke slot 26 to prevent the other work accessory from unfolding (as shown in FIGS. 7 and 8, when the second work accessory 23 unfolds, if the first work accessory 22 rotates toward the unfolding direction, the stroke slot 26 would prevent the pin from rotating, thus prevent the second work accessory from unfolding; as shown in FIGS. 9 and 10, when the first work accessory 22 unfolds, suppose the second work accessory 23 rotates toward the unfolding direction, the pin would prevent the stroke slot 26 from rotating, thus prevent the second work accessory from unfolding).

The pin 24 is set aside the pivot 25. The stroke slot 26 is set on a corresponding position of the second work accessory and it is arc-shaped. The stroke slot 26 is the travel path of the pin 24 during the first work accessory 22 or the second work accessory 23 rotating around the pivot 25 from folding to unfolding.

In order to secure the unfolded work accessory and prevent it from unexpected rotating, the first unfolding blocking part 27 as well as the second folding blocking part 28 inside the handle 21 are equipped to the first work accessory 22. When the first work accessory 22 is unfolded, the first unfolding blocking part 27 would prevent the first work accessory 22 from rotating toward the unfolding direction and the first folding blocking part 28 would prevent the first work accessory 22 from rotating toward the folding direction. The second unfolding blocking part 29 as well as the second folding blocking part 210 inside the handle 21 are equipped to the second work accessory 23. When the second work accessory 23 is unfolded, the second unfolding blocking part 29 would prevent the second work accessory 23 from rotating toward the unfolding direction and the second folding blocking part 210 would prevent the second work accessory 23 from rotating towards the folding direction.

Specifically, the first folding blocking part 27 is a block set along the unfolding direction of the first work accessory 22. The first folding blocking part is a rigid chip on the side of the first work accessory 22. When the first work accessory 22 is unfolded, the end of the rigid chip would bend to the first work accessory elastically and hold against the first work accessory to prevent it from folding (as shown in FIGS. 1, 9-10, before the first work accessory is folded, the rigid chip should be pushed aside toward the first work accessory, thus the first work accessory can be folded). The second folding block part 29 is a block along the unfolding direction of the second work accessory 23. The second folding block part 210 is a rigid chip on the side of the second work accessory 23. When the second work accessory 23 is unfolded, the end of the rigid chip would bend to the second work accessory elastically and hold against the second work accessory to prevent it from folding (as shown in FIGS. 1, 7-8, before the second work accessory is folded, the rigid chip should be pushed aside toward the second work accessory, and the second work accessory can be folded). In order to make the structure compact, between the first work accessory 22 and the second work accessory 23, the plate 211 is set inside the handle. The first unfolding blocking part 27, the first folding blocking part 28, the second unfolding blocking part 29 and the second folding blocking part 210 are set on the plate 211. In order to make the structure in order, the outlines of the two sides of the plate 211 are the same with or smaller than that of the handle. So that with the pivot fixing the plate on the end of the handle, a through hole of the same size and shape with the stroke slot is set on the plate to allow the pin mentioned before go through it.

Referring to the Figures, the first work accessory or the second work accessory is a blade mounting frame with a replaceable blade while the other one is a general knife.

Embodiment 3 (Referring to FIGS. 20-28)

In the embodiment, the manual tool capable of unfolding only one work accessory has a constraining state in addition to the unfolding state and the folding state. In this case, the unfolding state may comprise full unfolding and unfolding at an angle (for example, unfolding at 90 degrees, 120 degrees, 160 degrees, etc.). In the unfolding state, the first work accessory 32 or the second work accessory 33 may be used. The constraining state refers to a state between the folding state and the unfolding state, and in this state, both the first work accessory 32 and the second work accessory 33 are unfolded at an angle, but neither of the two work accessories can be used; when one of the first work accessory 32 and the second work accessory 33 continues opening to the unfolding state, the other should first return to the folding state.

Figure 20:
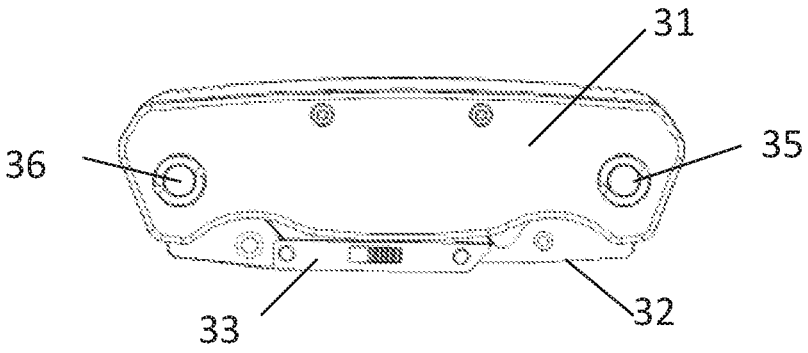
FIG. 20 is a schematic drawing of another structure of the invention which is in the folding state.
Figure 21:
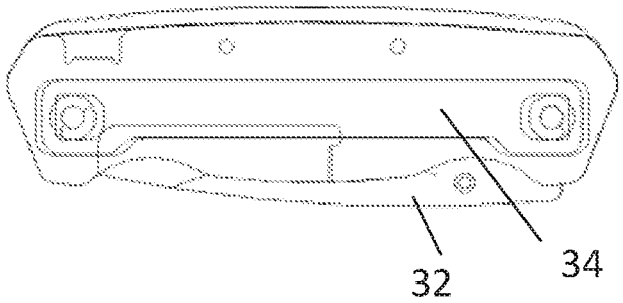
FIG. 21 is a section view of FIG. 20.

As shown in FIGS. 20, 21, 24 and 25, a through hole 321 is provided on the end of the first work accessory 32, and through the through hole 321, the first work accessory 32 is rotationally arranged to the first pivot 35 located at one end of the handle 31. A through hole 331 is provided on the end of the second work accessory 33, and through the through hole 331, the second work accessory 33 is rotationally arranged to the second pivot 36 located at the other end of the handle 31. Referring to FIG. 21, the associated accessory 34 is a pull rod assembled in the handle 31 and can move along its length. The two ends of the pull rod are surrounding the first pivot 35 and the second pivot 36 through the first through hole 341 and the second through hole 342 respectively. In another alternative embodiment, the first through hole 341 and the second through hole 342 can be connected, that is to say, one end, close to the first work accessory, of the connected through hole is a first locking wall 343, and one end, close to the second work accessory, of the connected through hole is a second locking wall 344.

The first member 37 is fixed on the first work accessory 32 and moves with the folding and unfolding of the first work accessory 32; the second member 38 is fixed on the second work accessory 33 and moves with the folding and unfolding of the second work accessory 33; the first member 37 and the second member 38 are set on the two ends of the pull rod 34 respectively; the first work accessory 32 drives the first member 37 to move after its unfolding, this drives the pull rod 34 to move correspondingly, to limit the motion of the second member 38, thereby preventing the second work accessory 33 from unfolding.

In this case, the first member 37 projects from the side of the first work accessory 32 while the second member 38 projects from the side of the second work accessory 33. The pull rod 34 has stroke slots respectively on the corresponding positions at the two ends. The first member 37 and the second member 38 extend into the corresponding stroke slots respectively. The first work accessory or the second work accessory would drive the first member or the second member to move when unfolds, thus drive the pull rod 34 to move correspondingly. The pull rod changes the position after moving, thereby preventing another work accessory from unfolding.

Figure 24:
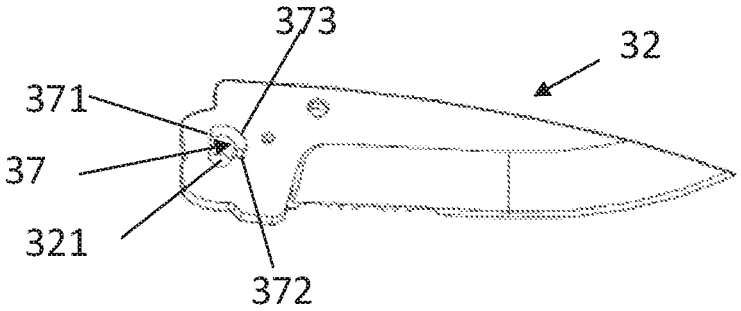
FIG. 24 is a schematic drawing of the first work accessory of the structure shown in FIG. 20.
Figure 25:
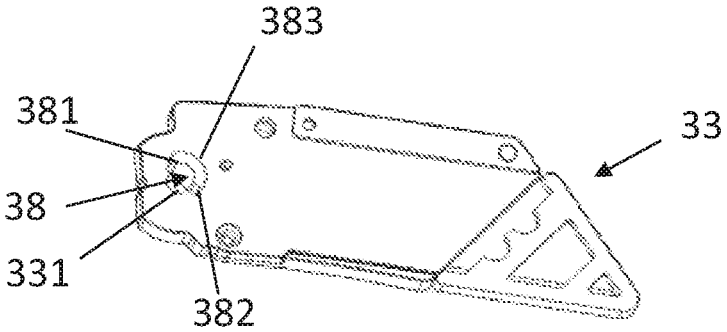
FIG. 25 is a schematic drawing of the second work accessory of the structure shown in FIG. 20.

In the embodiment, as shown in FIGS. 24 and 25, the first member 37 and the second member 38 are arc-shaped protrusions arranged at peripheries of the pivots of the first work accessory 32 and the second work accessory 33 respectively, and can rotate around the pivots with the rotation of the first work accessory 32 and the second work accessory 33 respectively. The first member 37 has a first end 371, a first arc surface 373 and a second end 372. The second member 38 has a third end 381, a second arc surface 383 and a fourth end 382. The stroke slots are a first through hole 341 and a second through hole 342 of the pull rod. The first member 37 and the second member 38 respectively extend laterally into the first through hole 341 and the second through hole 342. The first through hole 313 of the pull rod has a first locking wall 315 and the second through hole 314 has a second locking wall 316. The movement of the first work accessory and the second work accessory is controlled by the mutual movement of the first member 37, the second member 38 and the locking walls.

As shown in FIGS. 20 and 21, in the folding state where the first work accessory 32 and the second work accessory 33 are both folded, the first member 37 is not in contact with the first locking wall 343 and the second member 38 is not in contact with the second locking wall 344, the pull rod 34 can move along its length without preventing any work accessory from unfolding.

Figure 22:
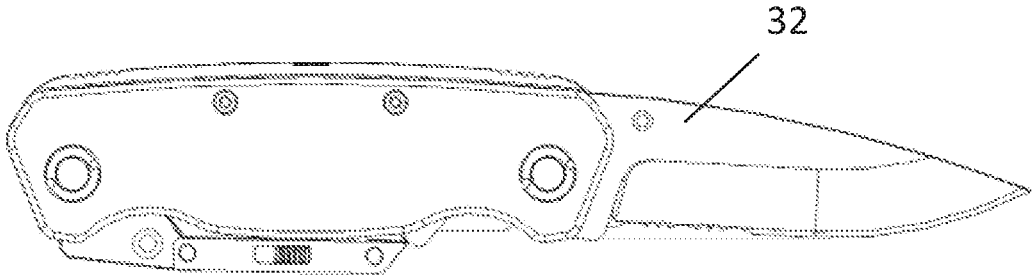
FIG. 22 is a schematic drawing of the unfolded first work accessory of the structure shown in FIG. 20.
Figure 23:
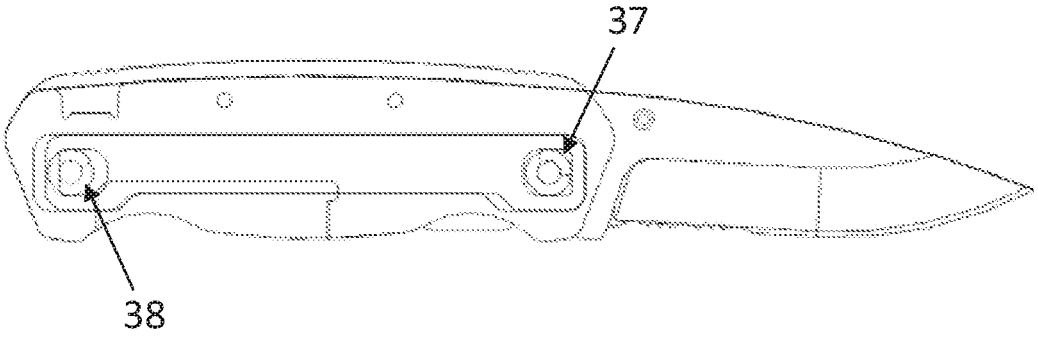
FIG. 23 is a section view of FIG. 22.

The unfolding state is divided into full unfolding position and partial unfolding position. As shown in FIGS. 22 and 23, when a work accessory is in the full unfolding position, that is to say, the first work accessory 32 or the second work accessory 33 is fully unfolded (corresponding to rotating 180 degrees to unfold from the folding position) while the other is in the folding position. When rotating to unfold from the folding position, the first work accessory 32 drives the first member 37 to rotate towards the first locking wall 343, the first end of the first member 37 comes into contact with the first locking wall 343, the first member 37 continues rotating, the first arc surface 373 pushes the first locking wall 343 to drive the pull rod to move towards one end of the first work accessory 32, and the first member 37 continues rotating, the second end 372 of the first member 37 comes into contact with the first locking wall 343, in this case, the first end 371 of the first member 37 has left the first locking wall 343 to eventually fully unfold the first work accessory 32. When rotating to unfold from the folding position, the second work accessory 33 drives the second member 38 to rotate towards the second locking wall 344, the third end 381 of the second member 38 comes into contact with the second locking wall 344, the second member 38 continues rotating and the second arc surface 383 pushes the second locking wall 344 to drive the pull rod to move towards one end of the second work accessory 33, and the second member 38 continues rotating, the fourth end 382 of the second member 38 comes into contact with the second locking wall 344, and in this case, the third end 381 of the second member 38 has left the second locking wall 344 to eventually fully unfold the second work accessory 33.

Figure 26:
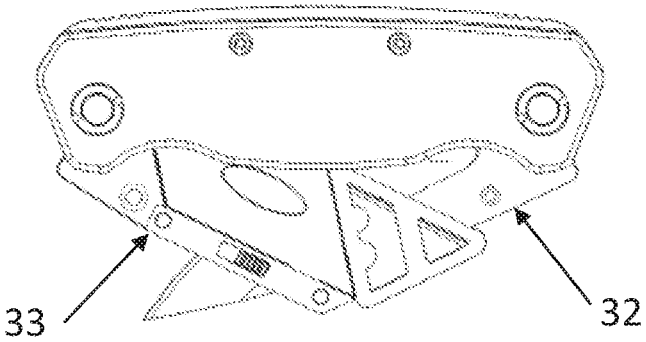
FIG. 26 is a schematic drawing of the first work accessory and the second work accessory of the structure shown in FIG. 20 which are in the constraining state.
Figure 27:
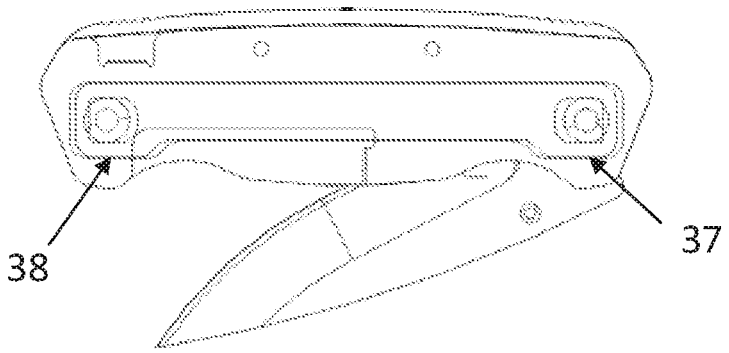
FIG. 27 is a section view of FIG. 26.
Figure 28:
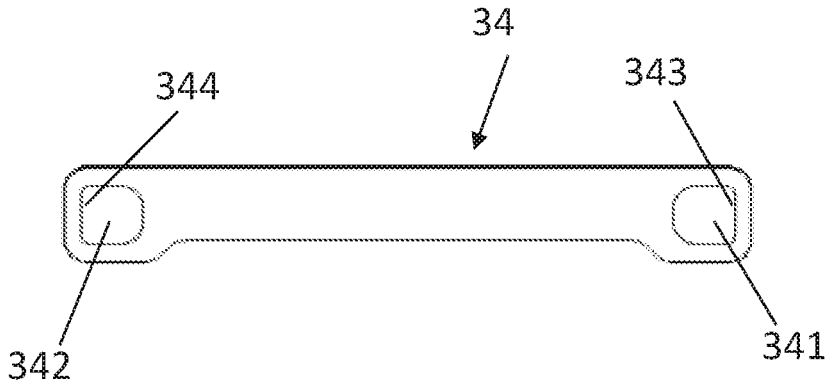
FIG. 28 is a side view of a portion of the accessory illustrated in FIG. 27.

As shown in FIGS. 26 and 27, when both the work accessories are in the constraining state where both the first work accessory 32 and the second work accessory 33 rotate to be opened partially, the first end 371 of the first member 37 comes into contact with the first locking wall 343 and the third end 381 of the second member 38 comes into contact with the second locking wall 344 so that the pull rod cannot move. Therefore, neither the first work accessory 32 nor the second work accessory 33 can open to the working position. When the first work accessory 32 is to further open from the constraining state, the second work accessory 33 needs to return to the folding position, and in this case, the first work accessory 32 can continue to open to the unfolding state. When the second work accessory 33 is to further open from the constraining state, the first work accessory 32 needs to return to the folding position, and in this case, the second work accessory 33 can continue to open to the unfolding state.

A distance between the first locking wall 343 and the second locking wall 344 is larger than or equal to an utmost outer distance between the first member 37 and the second member 38 when the second end 372 of the first member 37 is in contact with the first locking wall 343 and the third end 381 of the second member 38 is in contact with the second locking wall 344; the distance is also larger than or equal to an utmost outer distance between the first member 37 and the second member 38 when the fourth end 382 of the second member 38 is in contact with the second locking wall 344 and the first end 371 of the first member 37 is in contact with the first locking wall 343; and the distance is smaller than an utmost outer distance between the first member 37 and the second member 38 when the second end 372 of the first member 37 is in contact with the first locking wall 343 and the fourth end 382 of the second member 38 is in contact with the second locking wall 344.

The first locking wall has a first protrusion, and the second locking wall has a second protrusion. A notch capable of matching the first protrusion is arranged on the first arc surface of the first member, and a notch capable of matching the second protrusion is arranged on the second arc surface of the second member. When the first work accessory rotates to drive the first member to rotate, the notch located on the first arc surface engages with the first protrusion on the first locking wall, so that the first work accessory stays in the working position. The first arc surface may be provided with a plurality of notches to allow the first work accessory to stay in the partial unfolding state, for example, to allow the first work accessory to stay in the working position at 90 degrees, 120 degrees and 160 degrees relative to the folding position. When the second work accessory rotates to drive the second member to rotate, the notch located on the second arc surface engages with the second protrusion on the second locking wall, so that the second work accessory stays in the working position. The second arc surface may be provided with a plurality of notches to allow the second work accessory to stay in the partial unfolding state, for example, to allow the second work accessory to stay in the working position at 90 degrees, 120 degrees and 160 degrees relative to the folding position.

The invention claimed is:

1. A manual tool capable of unfolding only one work accessory, comprising a handle, a first work accessory and a second work accessory; the first work accessory and the second work accessory connected to the handle through at least one pivot and are capable of folding and unfolding;

wherein an associated accessory is arranged for a working state of the first work accessory and the second work accessory to transform from a folding state to an unfolding state, the folding state being that both the first and second work accessory are folded, the unfolding state being that one of the first work accessory and the second work accessory is unfolded while the other one is folded; in the folding state, the associated accessory being not capable of preventing any work accessory from unfolding; while in the unfolding state, the associated accessory prevents the other one from unfolding;

wherein the at least one pivot comprises two pivots, and the first work accessory and the second work accessory are connected to two sides of the handle through the pivots respectively;

wherein the associated accessory is a pull rod, a first member fixed on the first work accessory and moves with the folding and unfolding of the first work accessory, a second member fixed on the second work accessory and moves with the folding and unfolding of the second work accessory, the first member and the second member coupled to two ends of the pull rod respectively, the first work accessory driving the first member to move after its unfolding, thus to drive the pull rod to move correspondingly to prevent the second member from moving, and thus the second work accessory cannot be unfolded;

wherein the first member projects from a side of the first work accessory and is arc-shaped, and the second member projects from a side of the second work accessory and is arc-shaped; the pull rod provided with a first through hole and a second through hole on corresponding positions of the two ends of the pull rod, the first member laterally extending into the first through hole and the second member laterally extending into the second through hole so that the first member and the second member can drive the pull rod to move correspondingly;

wherein the first member is provided with a first end, a second end and a first arc surface arranged between the first end and the second end, and the second member is provided with a third end, a fourth end and a second arc surface arranged between the third end and the fourth end, and the first through hole is provided with a first locking wall, and the second through hole is provided with a second locking wall; and wherein the manual tool further has a constraining state, and in the constraining state, the first work accessory and the second work accessory both being opened partially, the first end of the first member contacting with the first locking wall of the first through hole and the third end of the second member contacting with the second locking wall of the second through hole so that the pull rod cannot move.

2. The manual tool capable of unfolding only one work accessory according to claim 1, wherein in the folding state, both the first work accessory and the second work accessory are folded, the first member is not in contact with the first locking wall, and the second member is not in contact with the second locking wall, so that the pull rod can move along its length without preventing any work accessory from unfolding;

in the unfolding state, one of the first work accessory and the second work accessory is fully unfolded while the other one is in a folding position; when rotating to unfold from the folding position, the first work accessory drives the first member to rotate towards the first locking wall, the first end of the first member comes into contact with the first locking wall, the first member continues rotating, the first arc surface pushes the first locking wall to drive the pull rod to move towards one end of the first work accessory, the first member continues rotating, the second end of the first member comes into contact with the first locking wall to fully unfold the first work accessory; when rotating to unfold from the folding position, the second work accessory drives the second member to rotate towards the second locking wall, the third end of the second member comes into contact with the second locking wall, the second member continues rotating, the second arc surface pushes the second locking wall to drive the pull rod to move towards one end of the second work accessory, and the second member continues rotating, the fourth end of the second member comes into contact with the second locking wall to fully unfold the second work accessory.

3. The manual tool capable of unfolding only one work accessory according to claim 2, wherein a distance between the first locking wall and the second locking wall is larger than or equal to an utmost outer distance between the first member and the second member when the second end of the first member is in contact with the first locking wall and the third end of the second member is in contact with the second locking wall; the distance is also larger than or equal to an utmost outer distance between the first member and the second member when the fourth end of the second member is in contact with the second locking wall and the first end of the first member is in contact with the first locking wall; and the distance is smaller than an utmost outer distance between the first member and the second member when the second end of the first member is in contact with the first locking wall and the fourth end of the second member is in contact with the second locking wall.

4. The manual tool capable of unfolding only one work accessory according to claim 2, wherein the unfolding state comprises full unfolding and partial unfolding; during full unfolding, the first work accessory or the second work accessory rotates 180 degrees relative to the folding position; during partial unfolding, the first work accessory or the second work accessory rotates an angle smaller than 180 degrees relative to the folding position.

5. The manual tool capable of unfolding only one work accessory according to claim 2, wherein the constraining state is between the unfolding state and the folding state; and in the constraining state, when one of the first work accessory and the second work accessory continues opening to the unfolding state, the other one first returns to the folding state.

* * * * *